United States Patent [19]

Czekala

[11] Patent Number: 5,052,163

[45] Date of Patent: Oct. 1, 1991

[54] FRAMED PANEL ASSEMBLY

[75] Inventor: Michael K. Czekala, Alpharetta, Ga.

[73] Assignee: Georgia Doors & Plywood Service, Inc., Alpharetta, Ga.

[21] Appl. No.: 441,822

[22] Filed: Nov. 27, 1989

[51] Int. Cl.[5] ..... E06B 3/62

[52] U.S. Cl. ..... 52/775; 52/773; 52/766

[58] Field of Search ..... 52/766, 773, 775, 776

[56] References Cited

U.S. PATENT DOCUMENTS

| | | | |
|---|---|---|---|
| 464,004 | 12/1891 | Berry | 52/786 |
| 617,626 | 1/1899 | Allen | 52/786 |
| 760,981 | 5/1904 | Goldsmith | 52/786 |
| 1,892,104 | 2/1932 | Hunter | 52/397 |
| 2,827,141 | 3/1958 | Kessler | 52/775 |
| 2,830,684 | 4/1958 | Bancroft | 52/775 |
| 3,144,689 | 8/1964 | Migneault et al. | 52/775 X |
| 3,158,909 | 12/1961 | Downs | 52/202 |
| 3,169,281 | 2/1965 | Clements Jr. | 52/775 X |
| 3,527,010 | 5/1968 | Brezinski | 52/397 |
| 3,978,554 | 9/1976 | Miller | 52/712 |
| 3,982,371 | 9/1976 | Preu | 52/773 |
| 4,624,094 | 11/1986 | Schwindt | 52/786 |

FOREIGN PATENT DOCUMENTS

| | | | |
|---|---|---|---|
| 662500 | 5/1963 | Canada | 52/776 |
| 1228973 | 9/1960 | France | 52/775 |

*Primary Examiner*—Richard E. Chilcot, Jr.
*Assistant Examiner*—Deborah M. Ripley
*Attorney, Agent, or Firm*—Hurt, Richardson, Garner, Todd & Cadenhead

[57] ABSTRACT

An open frame has a shoulder which is inwardly on the outward surface of the frame and receives a flat rectangular panel with the edge portions of the panel against said shoulder. A continuous groove around the inner portion of said frame receives a bezel which protrudes into said groove and outwardly over the edge portions of the frame. The bezel is biased inwardly as to firmly hold the frame in place. The bezel can be removed by urging it toward the center of the frame.

3 Claims, 2 Drawing Sheets

FRAMED PANEL ASSEMBLY

FIELD OF THE INVENTION

This invention relates to the framed panel assembly and is more particularly concerned with a mirrored door.

In the past, framed structures which contain the frame and a panel disposed within the frame have been extensively used for windows, doors, picture frames and the like. Usually prior art structures have included a frame which surrounds the panel and elements which extend inwardly from the frame so as to confine the panel within the frame. When such panels have been made of glass or other easily shattered materials, they have usually been installed by hand, the installer having to hammer elements into frame and above the edge portion of the panel, in order to lock the panel in place. Thereafter, other material such as putty is filled in over the edge portions of the panel to provide a pleasing appearance by covering the elements which secure the panel in place. Panel are also installed by gluing the beveled edges encircling the panel. The installation of the panels and the bezel usually requires the work of a skilled artisan, and depsite this there always remains a danger of damaging the panel, or shattering a glass panel.

Furthermore, when a mirrored panel is installed it may have to be replaced at a later date because of clouding or distortion of the glass over a period of time. Replacing a mirror in a mirrored door usually requires substantial skill, because of the panel is mounted too tightly the mirror will shatter, and, if it is loosely mounted within the frame, the mirror will rattle when the door is opened and closed.

SUMMARY OF THE INVENTION

It is therefore an object of the present invention to provide a framed panel assembly which is inexpensive to manufacture and durable in structure.

Another object of the present invention is to provide a framed panel assembly in which the panel may be readily and easily mounted and dismounted, as desired. Another object of the present invention is to provide a framed panel assembly which requires no special tools in mounting the panel within the frame.

Another object of the present invention is to provide a framed panel assembly in which the panel is resiliently held in place and the bezel in frictionally retained in its seated position.

Another object of the present invention is to provide a framed panel assembly in which the panel does not readily become loose and is resiliently retained against vibration and rattling.

The present invention achieves the above objects by providing a frame which is preferably rectangular. The innner perimeter of the frame is provided with an inwardly protruding shoulder against which the edge portions of the panel are received and retained. Forwardly of the panel, the frame is provided within a inwardly opening perimetral groove whose function is to receive the bezel members. The rear surface defining the perimetral groove is on a plane with the front surface of the panel while the front surface defining the groove is spaced forwardly of and parallel to the rear surface defining the groove.

Received within the perimetral groove are a plurality of elastomeric bezel members, each member of which has essentially the same cross-section. In cross section each member has a narrow spine and an integrally formed larger body. The width of each spine corresponds generally to the width of the groove so that the spine of the bezel can be resiliently received within the groove and frictionally held by the groove after it has been received. The body, which is thicker than the spine protrudes outward over the edge portions of the panel.

The bezel is pressed against the panel to reduce the cross section of the spine when the rear spine of each bezel member is resiliently urged into engagement within the groove. The bezel members retain the edge portions of the panel in place because the resiliency of the bezel is sufficient to urge and seat the rear edge portions of the panel against the internal shoulders of the frame. The bezel members extend substantially the full length of the respective grooves in which they are received and the ends of the bezel members, being mitered at 45 degrees enable these ends to abut the ends of the mitered portions of the adjacent bezel members. Thus, once installed, the bezel members are quite firmly retained in place in the grooves and cannot be inadvertently dislodged.

In one embodiment of the invention, the bezel is illustrated as having no irregular surfaces to resist the removal of the spine from the groove while, in other embodiments, the bezel member is provided with flanges which form barbs which flair out to resist the removal of the spine of the bezel from the groove. The body portion of the bezel is substantially thicker than the spine of the bezel and is provided with a shoulder which abutts the inner surface of its frame member so as to limit the movement of the spine into its groove. This body is rounded along its outer surface to provide a uniform and pleasing appearance.

The resilient properties of the bezel allow it to expand and contract as the frame member expands and contracts and allow the bezel to firmly hold the mirror in its seated position. The bezel is sufficiently flexible that by the use of a tool, such as a screw driver, the bezel may be removed to replace panel.

Other objects, features and advantages of the present invention will become apparent from the following description when considered in conjunction with the accompanying drawing wherein like characters of reference designate corresponding parts.

DETAILED DESCRIPTION

Figure 3:
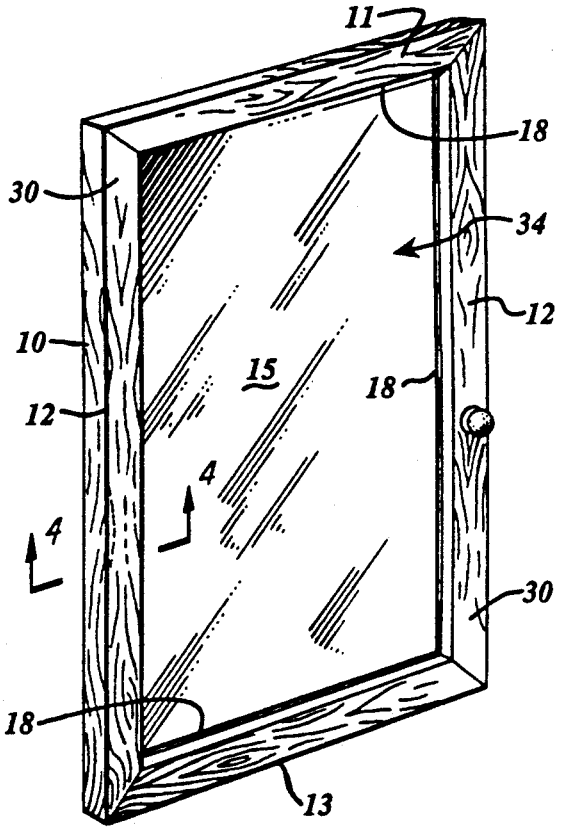
FIG. 3 is a prospective view of the framed panel assembly, constructed in accordance with the present invention.
Figure 4:
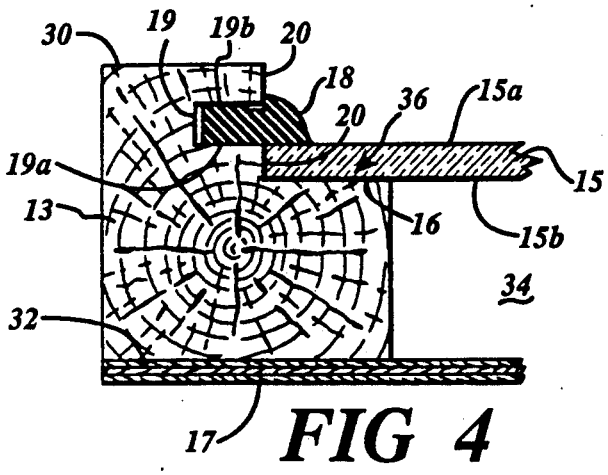
FIG. 4 is a cross sectional view taken substantially along line 4—4 in FIG. 3 showing the bezel of FIG. 1.

Referring now in detail to the embodiments chosen for the purpose of illustrating the present invention, in FIGS. 3 and 4, number 10 denotes generally a frame such as a rectangular door frame which initially has an open interior. The door frame 10 includes a pair of spaced apart, opposed, complimentary, parallel, straight, upright, struts 12 which, in cross-section, are genreally square or rectangular, as seen in FIG. 4 Mitered at 45 degrees, the upper portions of the struts 12 are joined by an upper cross bar 11 having mitered ends. In like fashion, the lower ends of the struts 12 are mitered and joined by a lower crossbar 13. A securing means, such as glue or adhesive, secures these mitered end portions, together to form the frame 10 defining an open interior 34 for receiving panel 15 as discussed below. A back wall 17, adhered to the back surface of the joined struts 11 and crossbars 12, 13, form the back of the door.

Each of the frame elements, namely the struts 11 and crossbars 12, 13 has a cross section which is esesntially identical to the cross section shown in FIG. 4. Thus, each has a front surface 30 and a rear surface 32, which are in a common plane parallel to back wall 17. Each front surface 30 is notched to provide a groove surface or wall 20 which faces the interior of the frame element 10 and a recessed shoulder 16 which faces forwardly. The shoulder receives an edge portion 36 of a flat, planar panel, such as mirror, 15. Since the shoulders 16, lie in a common plane each other, parallel to and inwardly of back 17, and are sufficiently spaced inwardly from the plane of the front surface 30 of frame 10, the thinner glass mirror 15 is recessed within the confines of frame 10, inwardly parallel to both the front surface 30 of the frame 10 and its back wall 17.

The bezel receiving grooves 19 are each defined, in each of the frame elements, 11, 12 and 13, by inner surface **19*a* and outer surface 19*b*. Both inner and outer surface 19*a* and 19*b*, lie in planes substantially perpendicular to surface 20 of frame elements 11, 12 and 13. Surface 19*a* is in about the same plane as the outer surface 15*a* of the panel 15**.

The grooves 19 of frame elements 11, 12 and 13 form a continuous recess which opens inwardly, the outer surface **19*b* being parallel to and spaced forwardly of inner surface 19*a*. Both surfaces 19*a* and 19*b* are spaced inwardly from the front surface of the frame elements 11, 12 and 13. The groove wall or surface 20 extends perpendicularly from the edge of each shoulder 16 to the inner portion of the front surface 30 of the frame members 11, 12 or 13, as the case may be. Thus grooves 19 are perpendicular to their respective surfaces 20. Each surface 20 thus forms an abutment that limits the movement of the spine of the selected bezel member 18, 118, 218, into its groove 19**, as will be explained, hereafter.

Figure 1:
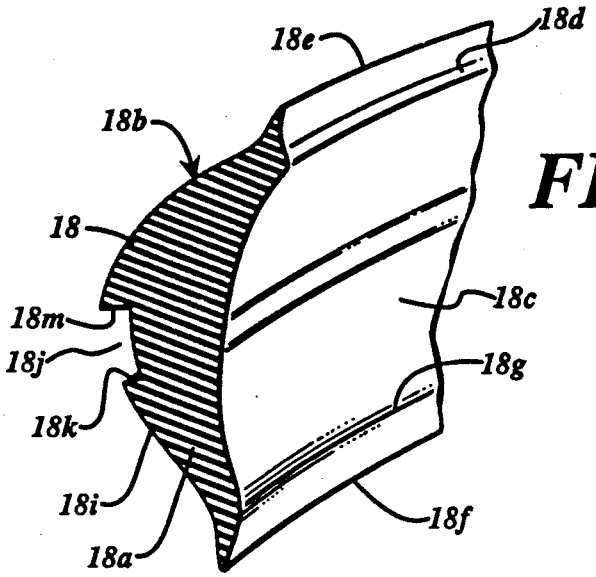
FIG. 1 is a fragmentary prospective view of a portion of the bezel member of the framed panel assembly of the present invention.
Figure 2:
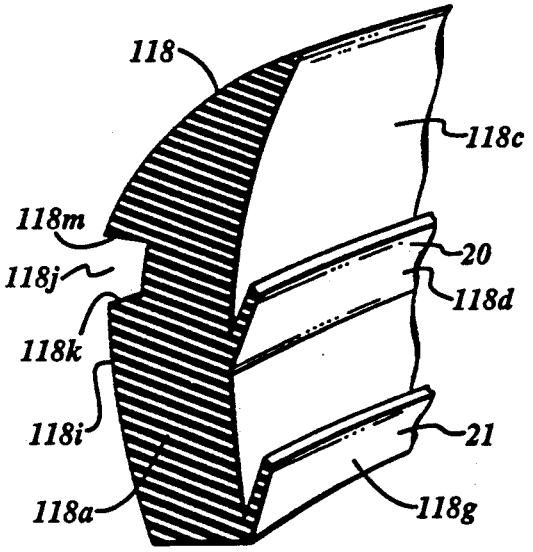
FIG. 2 is a fragmentary prospective view of the second embodiment of the bezel member of the present invention.
Figure 5:
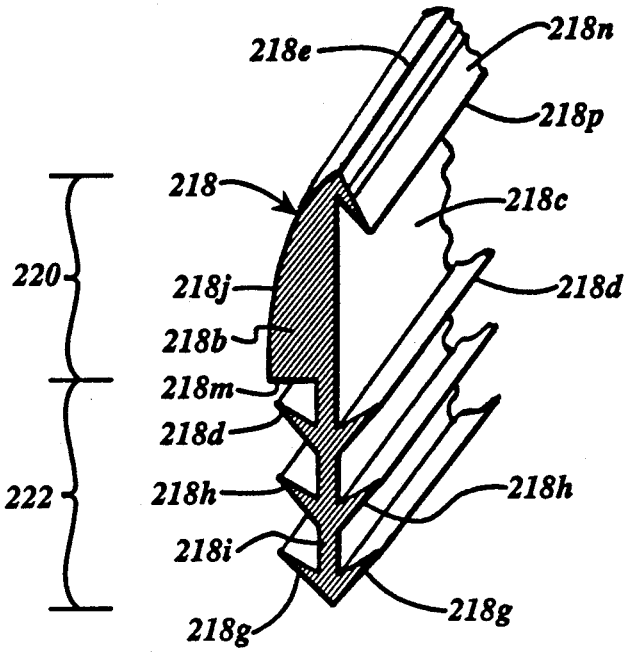
FIG. 5 is a fragmentary prospective view of a portion of a third embodiment of a bezel member of the present invention.

In FIGS. 1, 2 and 5 are illustrated suitable bezel members 18, 118 and 218, each of which is made of an extruded elastomeric material , such as polyvinyl chloride or other appropriate resilient plasticized thermoplastic material.

As seen in FIG. 1, the bezel member 18 is crescent shaped, having a spine **18*a*, which is adapted to be received within the groove 19 and a body 18*b*, which is integrally joined spine 18*a*. Body 18*b* protrudes from the spine 18*a* to provide an exposed portion of the bezel member 18 which is external of groove 19 and overlaps the edge of the panel 15**.

The bezel member 18, being crescent shaped in cross-section, has a bottom surface **18*c*, the central, portion of which is concaved about a longitudinal extending axis. In the body 18*b*, near the outer edge, the bottom surface 18*c* contains a longitudinally extending tapering outer lip 18*d* spaced from and parallel to the outer edge 18*e* of body 18*b*. A second tapering inner lip 18*g* also protrudes outwardly from bottom surface 18*c***.

On the opposite side of the bezel member 18, the top surface is generally convexed, having a central longitudinal channel running the length of the middle portion of bezel member 18. Spaced apart opposed upstanding ledges **18*k* and 18*m* define the longitudinal channel 18*j*. Channel 18*j* separates the convex top surface 18*i* of spine 18*a* and body 18*b*. Ledge 18*m* is higher than ledge 18*k* and forms a stop to abutt surface 20 and limit the insertion of the spine 18*a* into groove 19**.

When a bezel 18 is to be formed, four bezel members 18 which correspond in length to the lengths of grooves 19, in the frame members 12, 11 and 13 are produced. The ends of each length of bezel member 18 is cut at a 45 degree angle to abut similar mitered ends of an adjacent bezel members. The formed bezel member 18 is arranged adjacent to its individual groove 19 with the bottom surface **18*c* against surface 15*a*. Then the bezel member 18 is depressed, to flatten it, and is urged toward its groove 19 so that the spine 18*a* is received within the groove, such as groove 19, until the ledge 18*m* abuts surface or wall 20. This is done in succession. The last bezel member 18 however must be installed by flexing the central portion of bezel member 18 and by inserting the ends of the bezel member 18**, first, an then the central portion.

The spine **18*a* tapers toward edge 18*f*; however, the maximum thickness of spine 18*a* is greater than the width of groove 19. Therefore, as spine 18*a* is received in groove 19 the spine 18*a* is compressed so that at least a portion of spine 18*a* is deformed and thus when the spine 18*a* is fully inserted, it frictionally engages the opposed surface 19*a* and 19*b***.

In FIG. 2, a second bezel member 118 is illustrated. The bezel member 118 serves essentially the same function as the bezel member 18, however, it is of a different shape. Bezel member 118 is a crescent shaped member having a bottom surface **118*c*, which is concaved about a longitudinal extending axis, throughout, substantially the width of the bezel member 118. The lower portion of the bottom surface 118*c* is provided for the pair of transversely spaced, forwardly and outwardly protruding flanges 118*d* and 118*g*. Flange 118*g* is anchored to the bottom surface 118*c* adjacent to the rear edge 118*f* and protrudes in counterlever fashion, in the direction of the front edge 118*e*, diverging outwardly from the bottom surface 118*c*. The flanges 118*d* and 118*g* are flexible and, therefore, can be pivoted or deformed inwardly to flatten against bottom suface 118*c*, as the bezel member 118 is inserted into a groove, such as groove 19, seen in FIG. 4**.

The flange **118*d* is spaced from flange 118*g* and extends longitudinally, along approximately the mid portion of the bottom surface 118*c*. Flanges 118*g* and 118*d* have essentially the same dimensions and each connects integrally by a proximal edge portion to the back portion of bottom surface 118*c*. Like the flange 118*g*, the flange 118*d* protrudes in a direction of edge 118*e* but diverges from the bottom 118*c*. Both flanges 118*g*** and 118*d* are within the confines of the spine 118*a* so that they pivot and compress when the spine 118*a* is inserted into the groove 19.

The convexed top portion 118*i* of bezel member 118 is provided with a central longitudinal channel 118*j* defined by upstanding ledges 118*k* and 118*m*. Channel 118*j* divides the convexed top surface into the spine 118*a* and the body 118*b*. Ledge 118*m* is higher than ledge 118*k* and forms a stop to abut against surface 20 when the spine 118*a* has been fully inserted into the groove 19 as illustrated in FIG. 4. The bezel member 118 is inserted in essentially the same way as bezel member 18 and, therefore, there is no need to explain in detail how this is accomplished. Suffice it to state that the end portions of each bezel 118 is mitered so that each bezel member 118 abuts the mitered portions, of the next adjacent bezel member 118 when they are fully inserted into various grooves 19.

FIG. 5 discloses the preferred embodiment of the bezel members illustrated, namely bezel member 218. Briefly, this bezel member 218 comprises two portions, outer portion 222 and inner portion 220, and inlcudes a body 218*b* located on the inner portion 220 joining a spine 218*a* located on the outer portion 222. Inner portion 220 generally comprises body 218*b*, bottom 218*c*, front edge 218*e*, outer surface 218*j*, edge 218*m*, and bill or ledge 218*n* including distal edge 218*p*. Bottom 218*c* and bill or ledge 218*n* together define the inner edge of said inner portion 220. Outer portion 222 generally comprises spine 218*a*, opposed pairs of flanges 218*d*, 218*g* and 218*h*, and outer surface 218*i*.

The spine 218*a* has a plurality of pairs of opposed, outwardly longitudinally extending, tapering flanges 218*d*, 218*g* and 218*h* connected on both sides of rectangular spine 218*a*. The spine 218*a* is substantially less thick than the width between the surfaces 19*a* and 19*b* of the groove 19. Each of the flanges 218*d*, 218*h* and 218*g* is integrally joined by its proximal edge to the spine 218*a*, and are sufficiently flexible that these flanges 218*d*, 218*h* and 218*g* will pivot within their elastic limits inwardly about their proximal edges, so that opposed pairs of flanges 218*d*, 218*g* and 218*h* will be successively depressed as the spine 218*a* is inserted into the groove 19; however, when the spine 218*a* is to be withdrawn, these flanges act as continuous barbs which tend to pivot outwardly and thereby resist removal of spine 218*a* from the groove 19.

The body 218*b* is joined to the inner edge of the spine 218*a*, the body 218*b* having a convex outer surface 218*j* which curves from the front edge 218*e* of the bezel 218 form an arculate convex surface which terminates at a edge 218*m*. The edge 218*m* is essentially perpendicular to the outer surface 218*i* of the spine 218*a*.

A front ledge or bill 218*n* is connected by its proximal edge to front edge 218*e* of body 218*b* and extends longitudinally the full length of a front edge 218*e*. The configuration and materials of ledge or bill 218*n* and front edge 218*e* allow for ledge or bill 218*n* to be bent or to pivot about front edge 218*e* relative to body 218*b*, thus forming a yielding pivotal connection between ledge or bill 218*n* and body 218*b*. As discussed above, bezel 218 is made of an elastomeric material, and, in its proper functioning mode, bezel 218 is flexible. Ledge or bill 218*n* also is flexible and, as discussed in more detail below, is yieldably depressed toward bottom 218*c* when bezel 218 is inserted into frame 10 in its proper functioning mode.

Figure 6:
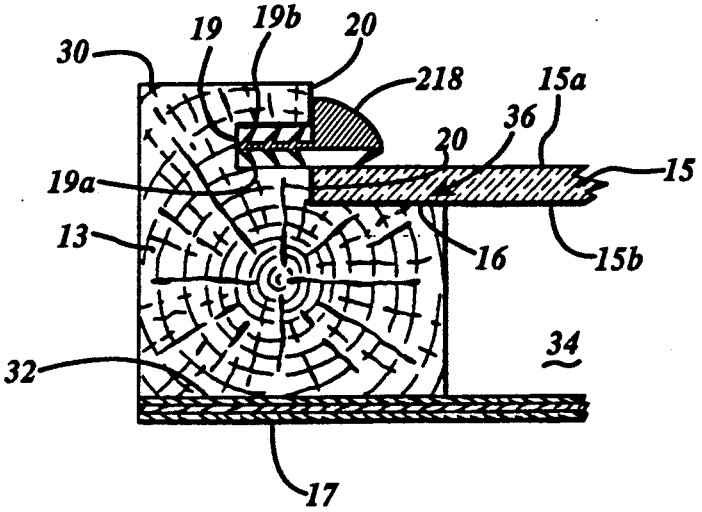
FIG. 6 is a cross sectional view taken substantially along line 4—4 in FIG. 3 showing the bezel of FIG. 5.

The front bill or ledge 218*n* protrudes angularly away from the bottom 218*c* of bezel 218 and terminates in a distal edge 218*p* which is spaced away from the bottom 218*c*. As shown in FIG. 6, when bezel 218 is inserted properly into groove 19, front bill or ledge 218*n* engages the front surface 15*a* of panel 15, with front bill or ledge 218*n* being sandwiched between panel 15 and bottom 218*c*. Thus, front bill or ledge 218*n* is adopted to engage and apply pressure to the outer edge portion 36 of panel 15 so that, in order for spine 218*a* of bezel member 218 to be inserted into the groove 19, the body 218*b* must be manually depressed, thereby depressing bill 218*n* against the panel 15 as spine 218*a* is forced into groove 19. Thus, when the manual force, against bezel member 218 is released, as when the shoulder 218*m* abuts the wall 20, the bill 218*n* will still exert a force against the panel 15 to urge it to a seated position on the surface 16. Bill 218*n* is of such a length that it will not reach as for as the edge of panel 15 and will terminate inwardly of groove 19 and wall 20. Flexible bill 218*n* is bent toward the inner portion 218*b* and extends from its proximal edge, attached to front edge 218*e* to its distal edge 218*p*. Bill 218*n* extends outwardly from the front edge 218*e* towards the outer portion 222 and away from bottom 218*c* and thus is located generally opposite bottom 218*c*. In operation, the bill 218*n* is depressed toward bottom 218*c* and becomes located between panel 15 and bottom 218*c* of bezel 218, thus exerting a seating pressrue against the edge portion 36 of the panel 15, inwardly of the perimetal edge of the panel 15, for seating said edge portions 36 of the panel 15 against the shoulder 16.

It will be understood that the bezel member 218 is sufficiently flexible that the bill 218*n* will be depressed toward the bottom 218*c* when the bezel member 218 is installed and, therefore, will retain the edge portion of the panel 15 in a biased condition, seating panel 15 against shoulder 16.

The present construction is particularly suitable for providing a mirror door 10 in which the panel 15 is made of glass or other transparent material and has a silvered inner surface 15*b* along the back surface of the panel 15. Of course, decorative panels may be employed which are made of wood, metal, plastic or any other suitable material. While it is preferable that the bezel members 18, 118 and 218 be formed of flexible resilient vinyl material, other plastics can readily be substituted for the vinyl material, provided they are thermoplastic in nature and are capable of being extruded.

It will be obvious to those skilled in the art that many variations may be made in the embodiments here chosen for the purpose of illustrating the present invention, without departing from the scope of the invention, as defined by the appended claims.

I claim:

1. A framed panel assembly comprising:

a rectangular frame having a front surface and a back surface and an open interior, said frame also having a shoulder in a plane rearwardly of said front surface for forming a panel receiving surface, said frame having an inwardly opening groove forwardly of said shoulder and in a plane parallel to said panel receiving surface;

a rectangular mirror within said frame, said mirror having a plurality of edge portions being received on said panel receiving surface, throughout the perimeter of said mirror; and a flexible plastic bezel having an outer portion received in said groove and an inner portion extending over each edge portion of said mirror, throughout the inner perimeter of said frame, said inner portion of said bezel comprising a front edge and having a flexible bill yieldably bent towards said inner portion of said bezel, said flexible bill comprising a proximal edge and a distal edge, said proximal edge of said flexible bill being attached to said front edge and said flexible bill extending from said front edge outwardly to said distal edge and being located between said inner portion of said bezel and said mirror and exerting seating pressure against said outer edge portion of said mirror inwardly of said edges of said mirror for seating said edge portions of said mirror against said shoulder.

2. The framed panel assembly defined in claim 1 wherein said bill is yieldably pivotally connected by its proximal edge to the front edge of the inner portion of said bezel.

3. The framed panel assembly defined in claim 2 including a plurality of flanges on both sides of said outer portion of said bezel, said flanges yieldably pivoting inwardly toward said outer portion of said bezel when the bezel is inserted into said groove for resisting removal from the groove.

* * * * *